United States Patent [19]

Hannus et al.

[11] Patent Number: 4,968,183

[45] Date of Patent: Nov. 6, 1990

[54] ARRANGEMENT FOR ANCHORING THE LEGS OF A MARINE TENSION LEG PLATFORM IN A FOUNDATION ON THE SEA FLOOR

[75] Inventors: Henrik Hannus, Oslo, Norway; Raymond E. Rogers, Hants, England

[73] Assignee: Kvaener Brug A/S, Oslo, Norway

[21] Appl. No.: 365,872

[22] Filed: Jun. 14, 1989

[30] Foreign Application Priority Data

Jun. 29, 1988 [NO] Norway ..... 882911

[51] Int. Cl.[5] ..... E02D 5/74; B63B 21/00; E02B 17/02

[52] U.S. Cl. ..... 405/224; 405/195; 405/203; 114/293; 403/349

[58] Field of Search ..... 405/195, 203, 224; 114/293, 294; 175/7; 166/241, 341; 403/348, 349

[56] References Cited

U.S. PATENT DOCUMENTS

| | | | |
|---|---|---|---|
| 4,320,993 | 3/1982 | Hunter | 405/224 |
| 4,432,670 | 2/1984 | Lawson | 405/224 |
| 4,459,933 | 7/1984 | Burchett | 114/297 |
| 4,611,953 | 9/1986 | Owens | 405/224 |
| 4,854,777 | 8/1989 | Lemoine et al. | 405/224 X |
| 4,869,615 | 9/1989 | Galle | 405/224 X |

FOREIGN PATENT DOCUMENTS 881419 3/1988 Norway .

*Primary Examiner*—Randolph A. Reese
*Assistant Examiner*—John Ricci
*Attorney, Agent, or Firm*—Finnegan, Henderson, Farabow, Garrett & Dunner

[57] ABSTRACT

In an anchoring arrangement for releasable anchoring of the legs of a marine tension leg platform in a foundation on the sea floor, the lower ends of the tension legs with an end head (1) are lowered into a cylindrical anchoring casing (4). For anchoring the leg in the foundation, locking elements (7) are provided at the tension leg insertion end of casing (4), on the inside of the cylindrical casing wall, for cooperation with bosses (2) on tension leg head (1). Anchoring casing (4) is, furthermore, on the outside of its cylindrical wall, at the insertion end, provided with further bosses/grooves (10). The latter are intended for cooperation with bosses (14,15) and grooves which are provided on the inside of a cylindrical steel ring (13), which is intended to be integrallly moulded into the foundation on the sea floor. Over the end edges of casing (4) and the cylindrical integral ring (13) a locking ring (16) is provided on a contact face to provide additional fixation of the anchoring.

7 Claims, 4 Drawing Sheets

Figure 1:
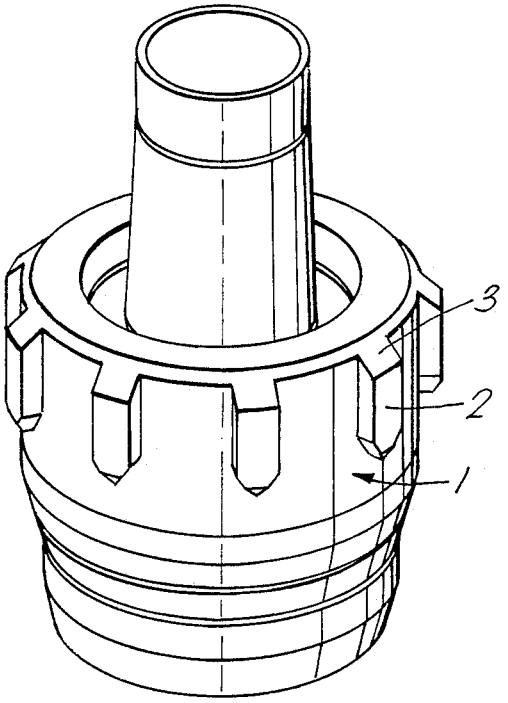

ARRANGEMENT FOR ANCHORING THE LEGS OF A MARINE TENSION LEG PLATFORM IN A FOUNDATION ON THE SEA FLOOR

The invention relates to an arrangement for releasable anchoring of the legs of a marine tension leg anchoring platform in a foundation on the sea floor, where the lower end of the tension legs is inserted into a cylindrical anchoring casing, and where cooperating locking means are provided on the leg end head and on the casing, which locking means, if desired, may be released by remote control or activation of the tension leg, and where said casing is also provided to be releasable in order to ensure releasability.

In tension leg anchoring platforms the tension members or tension legs are braced between the platform structure proper and a foundation on the sea floor. In such structures reliable anchoring of the tension legs in the foundation provided on the sea floor is most important. Such anchoring must comply with a series of requirements and must, inter alia, show a certain flexibility and pliability being achieved by an articulated structure in which rubber members are also used. Said structural members are provided in a tension leg head. The tension leg head must be attached in a reliable manner to the foundation, but one requirement of such anchoring will be that it should be releasable to permit members which for some reason are damaged or were subjected to corrosion to be replaced or repaired. To this aim a number of different anchoring systems for tension leg heads were developed.

Known technology to be referred to is NO-PS No. 153 840, corresponding to U.S. Pat. Nos. 4,459,933, and 4,320,993. According to the first mentioned patent a tension leg head comprising necessary members is firmly held by the aid of a segmented spring collar and wedges providing locking cooperation with the wall of an anchoring casing or anchoring chamber. To release the tension leg a plunger device is used to retract the wedges, so that the fixing mechanism is released. A disadvantage of this device is that special ropes are required to activate the plungers which ensure release of the plunger head when the tension leg is loosened. This also involves a complicated structure which can easily be subjected to operational errors.

In U.S. Pat. No. 4,320,993 another embodiment is disclosed, where an anchoring chamber or anchoring casing is inserted in the foundation and is firmly held by the aid of wedges in grooves in the wall area of the foundation. The tension leg head is again lowered into the casing and held there by the aid of wedges which are urged outwards under projections in the casing wall. When the tension leg is to be released, it is loosened and cooperation between oblique wedges should cause release of the head means. In case of failure, cylinders with pistons are provided adjacent to the wedges securing the casing to the foundation, which cylinders and pistons can urge fixing wedges into the casing wall so that the entire casing may be retrieved. In this case, too, supply of hydraulic fluid will be necessary, and the structure must be regarded as relatively vulnerable to errors if irregularities should occur in connection with the wedge effect between different elements.

It is, thus, an object of the present invention to provide a simple, but reliable anchoring arrangement for the tension legs of a tension leg platform, which is designed in such a manner that the tension legs can readily be mounted on the foundation, and that the tension leg head can be released in a simple manner without use of any additional components, hydraulic equipment, etc., and, if the tension leg head should be corroded in or other defects should have occurred, respectively, that a corresponding mechanism can be activated when it is desired to release the anchoring casing from remaining portions of the foundation. It is, furthermore, an object of the invention to provide anchoring means which can be readily and simply mounted, i.e. provided in the foundation, and which can be remote controlled by simple actuation of the tension leg.

Said objects are achieved by the aid of an anchoring arrangement of the kind mentioned above, which is characterized by the features stated in the claims.

By the aid of the invention an anchoring arrangement is achieved which is readily provided, where the void in the foundation for placing the anchoring casing does not require exact dimensioning, since the fixture means consists of an integrally moulded prefabricated steel ring, which ensures that the remaining elements are correctly placed. The principles of coupling and release will be the same both as regards the casing and the tension leg head, so that it will not be necessary to handle or learn several routines. If necessary, replacement may also readily be made in a simple manner. The invention per se, thus, constitutes an especially suitable embodiment of an anchoring arrangement for the tension legs of a tension leg platform.

Figure 5:
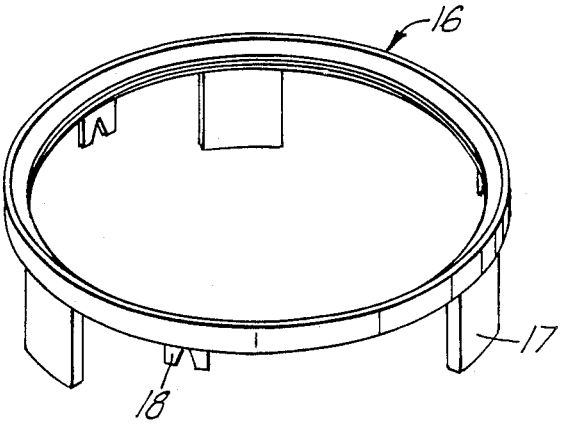
Figure 2:
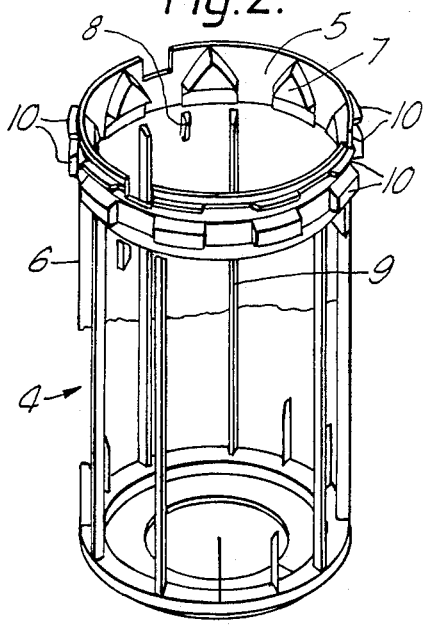
Figure 3:
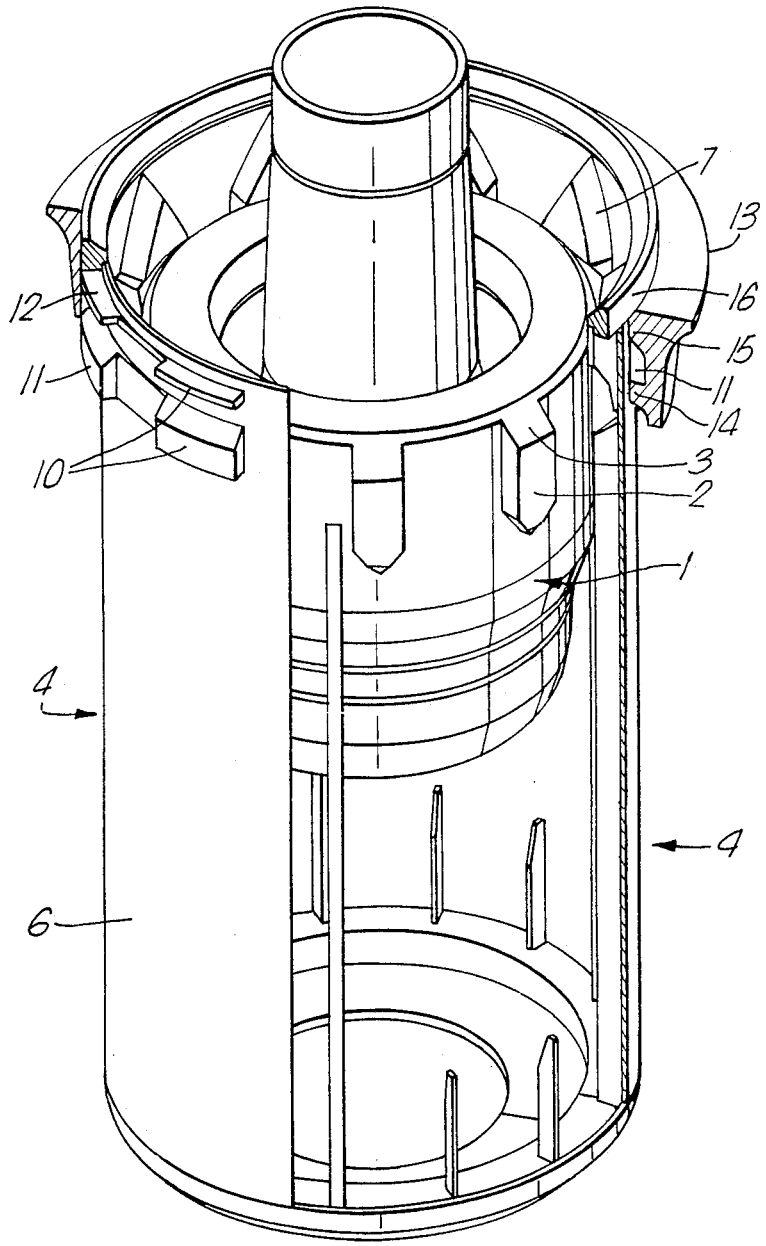
Figure 4:
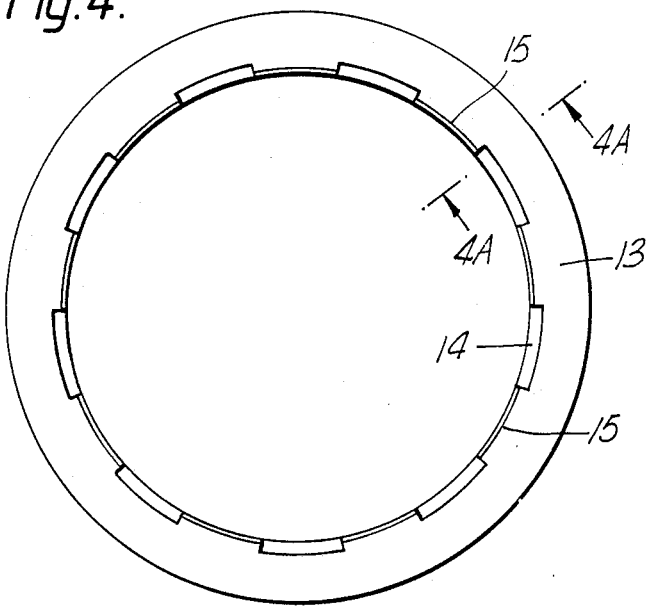

The invention is disclosed in more detail below with reference to an embodiment which is shown in the drawings, where FIG. 1 shows the end area of a tension leg with an end head designed according to the invention and illustrated in an isometric view, FIG. 2 shows an anchoring casing for the tension leg head according to FIG. 1, as seen in an isometric view with certain parts removed, and as seen in various sectional views, FIG. 3 is an isometric view of the tension leg head inserted in the anchoring casing, which is, in turn, secured to a ring integrated by moulding where parts are removed for surveyability, and FIG. 4 is a sectional view showing the integral ring and its cooperation with the anchoring casing, and FIG. 5 is an isometric view of a locking ring connecting the components.

As mentioned above, a tension leg head is commonly provided at the end of a tension leg which is to be attached to a foundation. Such a tension leg head should be designed to absorb various kinds of loads, and it should also show a certain flexibility, and is, thus, internally provided with various flexible members, rubber packings, etc. The structure of the internal load absorbing portion of the tension leg head does not constitute a special part of the invention, and different structures may be employed. It is, however, essential that the tension leg ends in such a manner in said head that it is possible to rotate the head by rotating the tension leg, and that the head follows when the leg is tensioned and loosened.

For anchoring a tension leg and, thus, tension leg head, the latter is provided with external teeth or bosses according to the present invention, in the present embodiment with nine such members. The tension leg head is designated by 1 in the Figures, whereas the bosses are designated by 2. The bosses are symmetrically distributed about the circumference of the head and have a pointed lower edge shape to provide a guide into grooves between other bosses, as will be disclosed below. In their upper portions the bosses are bevelled to an outward angle, preferably of 45°, which is advantageous as regards absorption of forces in the connection. This shape will also cause a certain axial self-centering effect for the head.

The tension leg head according to FIG. 1 is intended for anchoring in an anchoring casing generally illustrated in FIG. 2, where part of the casing wall is removed to improve surveyability. Casing 4 comprises two main members, viz. an upper flange member 5, and a lower cylindrical casing member 6. Internally, on upper flange member 5 bosses 7 are provided, in the shown embodiment again nine bosses, which are pointed in an upward direction, and provided with a bevelled lower edge, corresponding to the bevelled edge 3 on the bosses of tension leg head. On lower cylindrical member of the casing guide ribs 8 and 9 are provided to guide the tension leg in its movement, as explained below. In the lowermost portion of cylindrical member 6 additional guide means are provided to control head movement when the tension leg is loosened. The casing is finished by a lower flange member. The main portion of the casing may consist of a cylindrical mantle, but it is possible to omit such a mantle and build the casing like a structure consisting of an upper and a lower flange member with guide ribs between them. This would, however, result in a less rigid structure. The upper flange member, which should absorb tension loads and transmit them to the foundation, is manufactured from forged steel, and the bosses are machined, so that no welding operations are required.

Figure 2A:
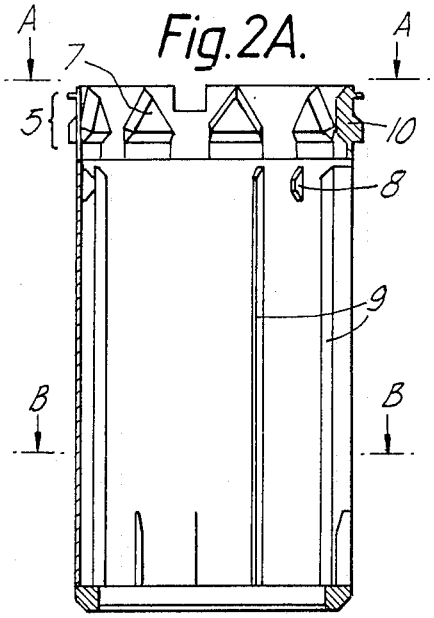
Figure 2B:
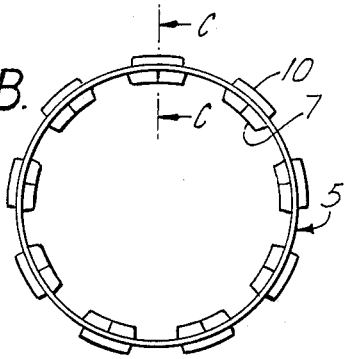
Figure 2D:
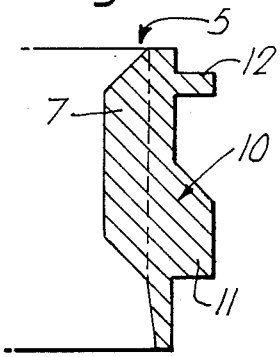
Figure 2C:
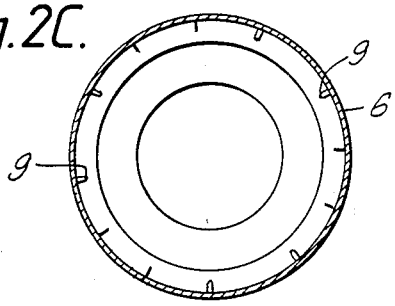

FIGS. 2*a*, 2*b*, and 2*c* show various sections illustrating the build-up of the anchoring casing more clearly. FIG. 2*d* is a section through upper flange member with the profile of internal bosses 7, and external bosses 10.

As indicated, upper flange member 5 is also provided with an external array of bosses, also comprising nine bosses in the shown embodiment. These bosses are divided, and comprise a lower boss portion 11, and an upper boss portion 12, as will appear clearly from FIG. 2*d*. In the shown embodiment, a narrow annular edge extends between upper boss portions 12, and across the space between bosses.

Figure 4A:
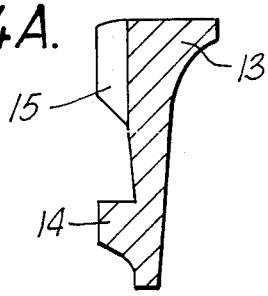

Said external array of bosses serves to anchor anchoring casing 4 to an external steel ring which is to be firmly moulded into the foundation. This design appears from FIG. 3. In FIG. 4 an elevational view of this integrated ring, designated 13, is shown. FIG. 4*a* is a sectional view of integrated ring 13 showing that the ring has an inward facing lower bead 14 extending continuously all along the ring, and an upper array of bosses 15 intended for cooperation with external bosses on anchoring casing.

Figure 4B:
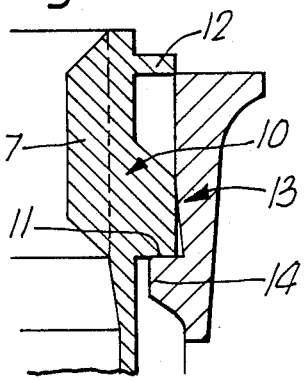
Figure 4C:
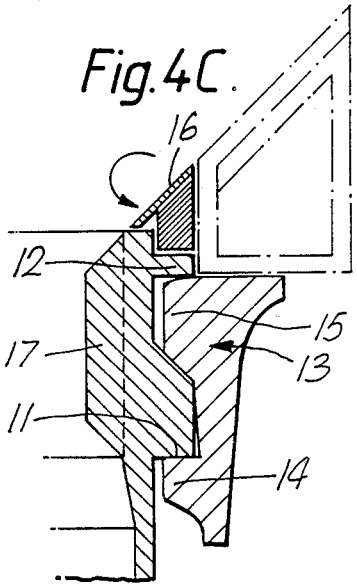

FIGS. 4*b* and *c* illustrate cooperation between integrated ring and casing, FIG. 4*b* illustrating insertion of the casing into the integrated ring, and FIG. 4*c* illustrating the fixing engagement between bosses.

FIG. 5 shows a locking ring which, upon attachment of the casing in the integrated ring, is mounted over the edges of casing and ring to seal off said components. This ring, which is designated by numeral 16, is provided with tags sealing the joint against rotation and being designated by numeral 17, as well as lifting lugs 18 to be used when the casing is to be released from the integrated ring.

For mounting the anchoring means ring 13, which is also manufactured from forged steel with machined grooves and bosses, is first moulded to be integrated with the foundation of the tension leg platform on the sea floor. Integrated ring 13 will, thus, form the circumferential edge or lead-in end to a hollow cylindrical space in the foundation. This is not shown in detail. The next step will be to provide the anchoring casing in the foundation. Anchoring casing 4 is lowered through the opening in integrated ring 13 with external bosses 10 placed to be guided between bosses 15 on ring 13. Casing 4 is lowered until lower portion 11 of bosses 10 bears against annular boss 14, upon which anchoring casing 4 is ready to be secured by being turned about its longitudinal axis. This can either be effected by suitable means at this stage, or rotation may be achieved by the aid of the tension leg later. Upon such rotation the inserted bosses, as illustrated in FIG. 4*b*, will be turned into the position as shown in FIG. 4*c*. It will appear from the latter that load transmission occurs, via bevelled faces on the bosses, and with the casing being held in a correct position by the aid of upper boss portion 12. For further fixing of this anchoring position, the locking ring is then placed over the connection of ring 13 and flange portion 5 of the casing. This is also diagrammatically illustrated in FIG. 4*c*, but will appear more clearly from FIG. 3. At this mounting step tabs 17 will enter (not shown) the open grooves between bosses 10 on casing flange 5 to lock against further rotation. To release this connection the ring is forced slightly upwards, and lifting strings can be attached to the lugs so that the ring can be removed, e.g. via a remotely controlled means. It will then be possible to rotate the casing relative to the integrated ring, so that the casing may be removed. This is, however, only intended to be a secondary safety measure in case the tension leg should be stuck in the anchoring casing for some reason and not be releasable. Anchoring of tension leg head 1 in anchoring casing 4 is achieved by inserting said head into the casing, head I being guided with its bosses 2 between the tips of internal bosses 7 of the casing. Due to the pointed shape tension leg head 1 will adjust itself correctly in the spaces between bosses 7 and can be lead down past the small lead-in ridge 8. After the bosses, i.e. the whole head, is guided past lead-in ridge 8 in a downward direction in the casing, the tension leg and, thus, head 1 is turned until it bears against ridge 9. Then the tension leg can be tensioned and the head will slide upwards under bosses 7. There it will bear against the underside of boss 7 with its oblique face 3, which will engage a corresponding oblique face on boss 7 to provide the best possible transmission of forces as well as centering of the head in the casing. Theoretically, one ridge 8, and preferably two ridges 9 would suffice, even though a plurality of arrays are used in practice. To release the tension leg for inspection or replacement, the tension leg is loosened, so that it will again slide down through the casing along lead-in ridge 9, until the top of the head has passed ridge 8. Then the tension leg is turned in the opposite direction of the direction for inserting, until it hits another ridge 9. It will, now, be in a correct position for being pulled out between bosses 7.

If, for some reason, it should be impossible to release the head from the casing it will, nevertheless, be possible to loosen the tension leg by breaking off locking ring 16, which sits on the connection between integral ring 13 and casing 4. Then the entire casing can be rotated by the aid of the leg, so that bosses 10 on the locking casing go clear of bosses 15 on the locking ring, and then the whole casing may be retrieved. A possibility of releasing the tension leg head in a simple and rapid manner is, thus, guaranteed in any situation. Due to the bevelled contact edges providing maximum transmission of forces, and use of machined coupling elements in stead of welded-on bosses, a very reliable and accurately operating anchoring arrangement is, at the same time achieved, which can be mounted and released in a simple manner. Employment of an integrated steel ring contributes to this possibility of placing and securing the anchoring accurately.

In the shown embodiment a design of separate members of the anchoring means was illustrated, but many modifications will obviously be possible within the scope of the invention. It was mentioned that casing 4 may have a mantle, or may be an open casing comprising a supporting framework, inter alia with ridges 9 and a bottom flange. The integrated ring may, furthermore, show a different design, and the design of bosses may also be modified within the scope of the invention. Also, a cone may be applied to simplify insertion of the tension leg. Said cone would be placed on the integrated ring, as diagrammatically illustrated in FIG. 4*c*. The securing system between head and casing may also be varied, even though it is preferred and most advantageous to use the same principles for both anchoring systems.

We claim:

1. An anchoring arrangement for releasable anchoring of the legs of a marine tension leg platform in a foundation on the sea floor, where the lower ends of the tension legs with an end head are lowered into a cylindrical anchoring casing, and where cooperating locking elements which, when necessary, may be released by remote actuation or actuation of the tension legs, are provided on the leg end head, and on the casing, and where the casing is also provided in a releasable manner to ensure releasability, characterized in that:

(a) locking elements for cooperation with bosses on the tension leg head are provided on the inside of the cylindrical casing wall at the tension leg insertion end of the casing, (b) further bosses/grooves are provided externally on the cylinder wall at the insertion end, (c) a cylindrical ring with grooves/bosses designed for cooperation with the external bosses/grooves on the casing is provided around the insertion end of the casing, which cylindrical ring is firmly moulded to be integrated with the foundation on the sea floor, and (d) a locking ring is provided over the edges of the casing and the cylindrical integrally moulded ring on a contact face.

2. An anchoring arrangement according to claim 1, characterized in that the cooperating locking means on the inside of the cylindrical casing wall and on the tension leg head are designed as cam shaped bosses extending in the longitudinal direction of the casing and head, respectively, which cam shaped bosses have pointed end portions facing each other, that the spaces between said bosses are in a manner known per se mutually adapted to achieve an effect of interlaced fingers, that at least one guide ridge is provided on the casing below the cam shaped bosses along the entire longitudinal extension of the cylindrical casing, like an extension of one lateral edge of a cam shaped boss, and at least one short guide ridge, extending in parallel with said first cam ridge and forming an extension of an opposite lateral edge of a cam shaped boss, and that correspondingly cooperating bosses are provided externally on the cylindrical casing wall, and on the integral ring.

3. An anchoring arrangement according to claim 7 or 2, characterized in that the tension leg head is rotatable relative to the casing.

4. An anchoring arrangement according to claim 1, characterized in that the locking ring has, preferably downwards facing lugs for release and removal of the locking ring when necessary, and that the locking ring, furthermore, has downwards depending tabs for alignment of the ring.

5. An anchoring arrangement according to claim 1, characterized in that the bosses on the outside of the casing are divided into two portions sitting below one another.

6. An anchoring arrangement according to claim 1, characterized in that the bosses are provided with a bevelled top end face.

7. An anchoring arrangement according to claim 1, characterized in that the casing is rotatable relative to said integral ring upon removal of said locking ring.

* * * * *

UNITED STATES PATENT AND TRADEMARK OFFICE

CERTIFICATE OF CORRECTION

PATENT NO. : 4,968,183

DATED : November 6, 1990

INVENTOR(S) : Henrik Hannus et al.

It is certified that error appears in the above-identified patent and that said Letters Patent is hereby corrected as shown below:

Column 6

Claim 3, line 1, change "7" to --1--.

Signed and Sealed this

Twenty-eighth Day of July, 1992

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 4,968,183

DATED : November 6, 1990

INVENTOR(S) : Henrik Hannus et al.

It is certified that error appears in the above-identified patent and that said Letters Patent is hereby corrected as shown below:

ON THE TITLE PAGE: Item [73] change Assignee from "Kvaener Brug A/S" to --Kvaerner Brug A/S--.

Signed and Sealed this

Fifteenth Day of December, 1992

*Attest:*

*Attesting Officer*

DOUGLAS B. COMER

*Acting Commissioner of Patents and Trademarks*